US005383165A

United States Patent [19]

Vaucher

[11] Patent Number: 5,383,165

[45] Date of Patent: Jan. 17, 1995

[54] TIMEPIECE WITH A UNIVERSAL TIME DISPLAY

[75] Inventor: Frank Vaucher, Cormoret, Switzerland

[73] Assignee: Compagnie des Montres Longines Francillon S.A., St-Imier, Switzerland

[21] Appl. No.: 93,063

[22] Filed: Jul. 16, 1993

[30] Foreign Application Priority Data

Jul. 17, 1992 [CH] Switzerland ..... 02266/92

[51] Int. Cl.[6] ..... G04B 19/22

[52] U.S. Cl. ..... 368/27; 368/185

[58] Field of Search ..... 368/27, 185, 21

[56] References Cited

U.S. PATENT DOCUMENTS 3,472,021 10/1969 Karakawa ..... 368/27
4,634,287 1/1987 Vuilleumier et al. ..... 368/27

FOREIGN PATENT DOCUMENTS 1795193 12/1984 Germany .
284845 12/1952 Switzerland .
515540 11/1971 Switzerland .
648449 3/1985 Switzerland .
662234 9/1987 Switzerland .

*Primary Examiner*—Bernard Roskoski
*Attorney, Agent, or Firm*—Weil, Gotshal & Manges

[57] ABSTRACT

The invention concerns a timepiece including a horometric movement (M) with a dial train (8, 46), at least one hours hand (4) which is mounted on an hours pipe (4a) driven by the dial train, a rotary ring (48) driven by the hours pipe so as to effect one revolution per twenty-four hours, a first display means (3) including a twenty-four-hour hours circle and a second display means including geographic indications respectively indicating various time zones, one of the display means (3) being arranged on the rotary ring (48) in order to be displaced facing the other (5) and in order to furnish with the latter a universal time display, characterized in that it includes a correction mechanism (MC) adapted to act on the hours hand (4) independently from the driving of the rotary ring (48).

7 Claims, 8 Drawing Sheets

TIMEPIECE WITH A UNIVERSAL TIME DISPLAY

The present invention concerns a timepiece furnishing a universal time display, i.e. capable of giving the current time in different time zones, in particular in combination with the local time at the place of the wearer.

BACKGROUND OF THE INVENTION

Timepieces of this type such, for example, as described in the patent document CH-A-662 234, generally include, within a case housing a standard horometric movement, a rotary crown or ring which effects a complete revolution in twenty-four hours and which is kinematically coupled to an hours wheel driven by the movement. Such rotary ring includes, in one specific embodiment, a twenty-four hour-hours circle while a bezel, on which geographic indications corresponding to the various time zones are inscribed and which, in this example, is operated by the stem, is assembled for rotation at the exterior of the case.

This timepiece exhibits numerous drawbacks.

Effectively, when the wearer happens to travel and must modify the time displayed at the crossing of a time zone, the time correction which is effected in a standard manner on the hours wheel produces a consequent rotation of the rotary ring and of the twenty-four hour-hours circle carried by the latter. The time information attached to the various time zones marked on the bezel is then falsified so that such latter must be rotated, in particular by an operation on the stem, in order once again to position the geographical indications facing the appropriate numbers on the rotary ring in order to furnish the exact "universal time" indication.

It is understood that this operation may bring about an erroneous display of the universal time, if, in rotating the bezel the user is mistaken in the angular positioning of the geographical indications.

Furthermore, it is understood that this arrangement forcibly requires the providing of a bezel exhibiting a rotatable structure which complicates the structure of the timepiece and substantially raises its cost.

It will also be noted that with this structure the geographic indication showing the time zone at which the user is located cannot be placed on the timepiece at a fixed angular position since the bezel in rotating is forcibly brought to be placed in any angular position whatsoever on the timepiece.

Thus, the present invention has as purpose To provide a timepiece with a universal time display which is of simple conception and in which the current time displayed may be modified without influencing the universal time.

The present invention also has as purpose to provide a timepiece of the type mentioned hereinabove provided with a date display.

SUMMARY OF THE INVENTION

To this effect, the invention has as object a timepiece with a universal time display including:

- a horometric movement including at least one dial train,
- at least one hours hand which is mounted on an hours pipe driven by said dial train,
- a rotary ring driven by the hours pipe in order to effect one revolution per twenty-four hours,
- a first display means including a twenty-four hour-hours circle, and
- a second display means including geographic indications respectively indicating various time zones, one of said display means being arranged on the rotary ring so as to be displaced facing the other and to furnish with the latter said universal time display characterized in that it includes a correction mechanism adapted to act on said hours hand independently from the driving of said rotary ring.

Other characteristics and advantages of the invention will appear upon reading the detailed description which follows, made having reference to the attached drawings which are given solely by way of example.

DESCRIPTION OF THE PREFERRED EMBODIMENT

Figure 1:
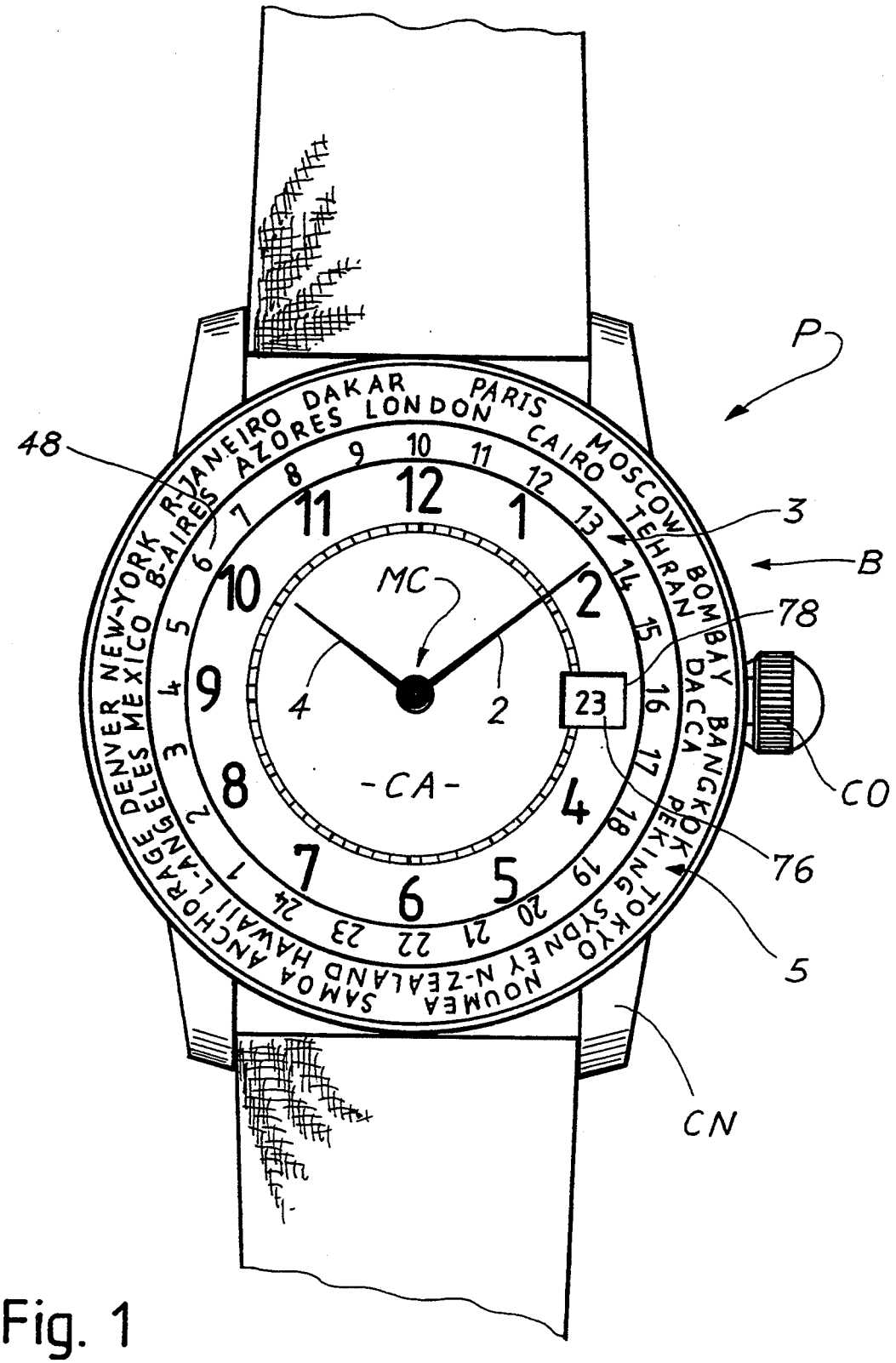
FIG. 1 is a top view of a timepiece according to the invention.

Referring initially to FIG. 1, there will be described hereinafter a timepiece according to the invention which is designated by the general reference P.

The timepiece P includes a case B on which are formed in a standard manner the lugs CN (a single one being referenced) enabling attachment of a standard bracelet (not referenced).

Timepiece P includes, in this example, two display hands, namely a minutes hand 2 and an hours hand 4 both rotating facing a dial CA in order to furnish analog time information generally corresponding to local time in the place where the wearer of the timepiece is located.

Timepiece P includes a first display means 3 referred to as the twenty-four hours display means comprising a twenty-four hour-hours circle (same reference) here shown in a standard manner by a group of arabic numbers 1 to 24. The timepiece P further includes a second display means 5 which comprises geographical indications (here the name of cities) relating respectively to various time zones.

Figure 2:
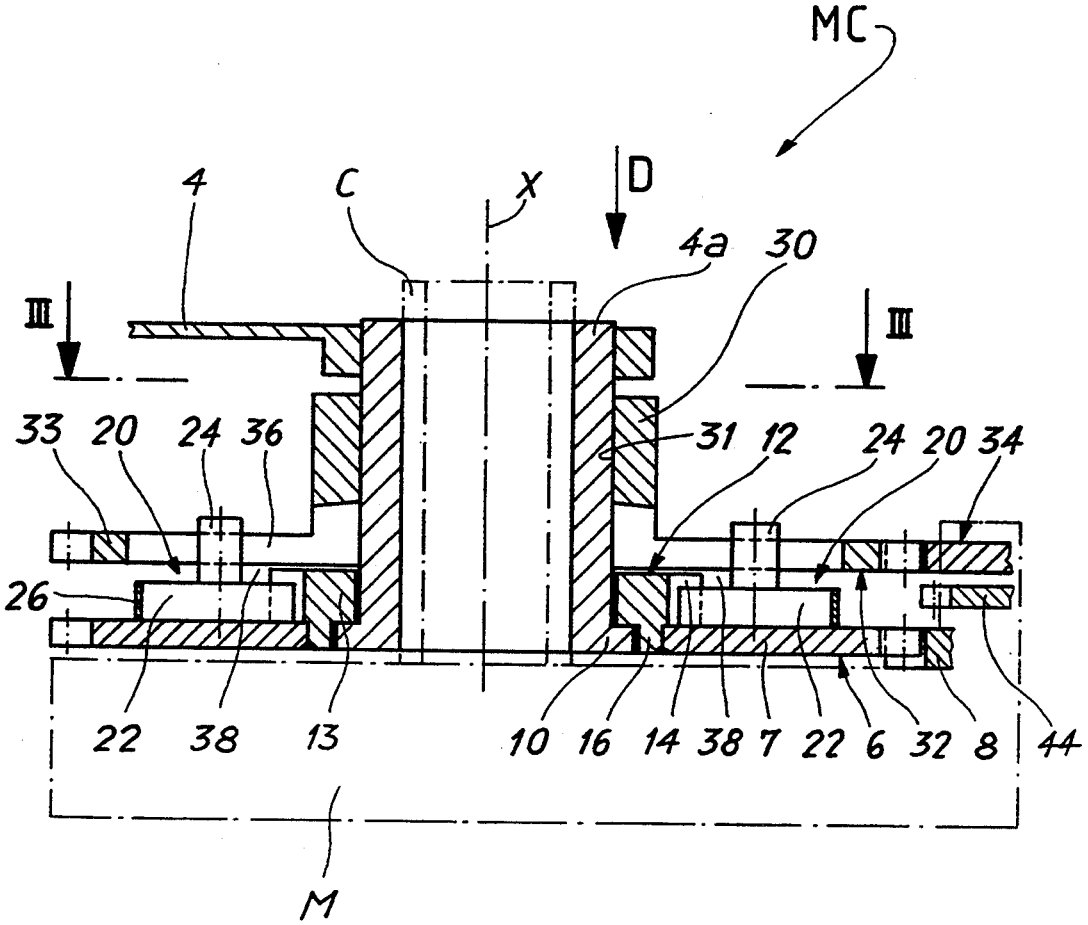
FIG. 2 which is a view taken along line II—II of FIGS. 3 and 5 shows in longitudinal cross-section a correction mechanism equipping the timepiece according to the invention.
Figure 6:
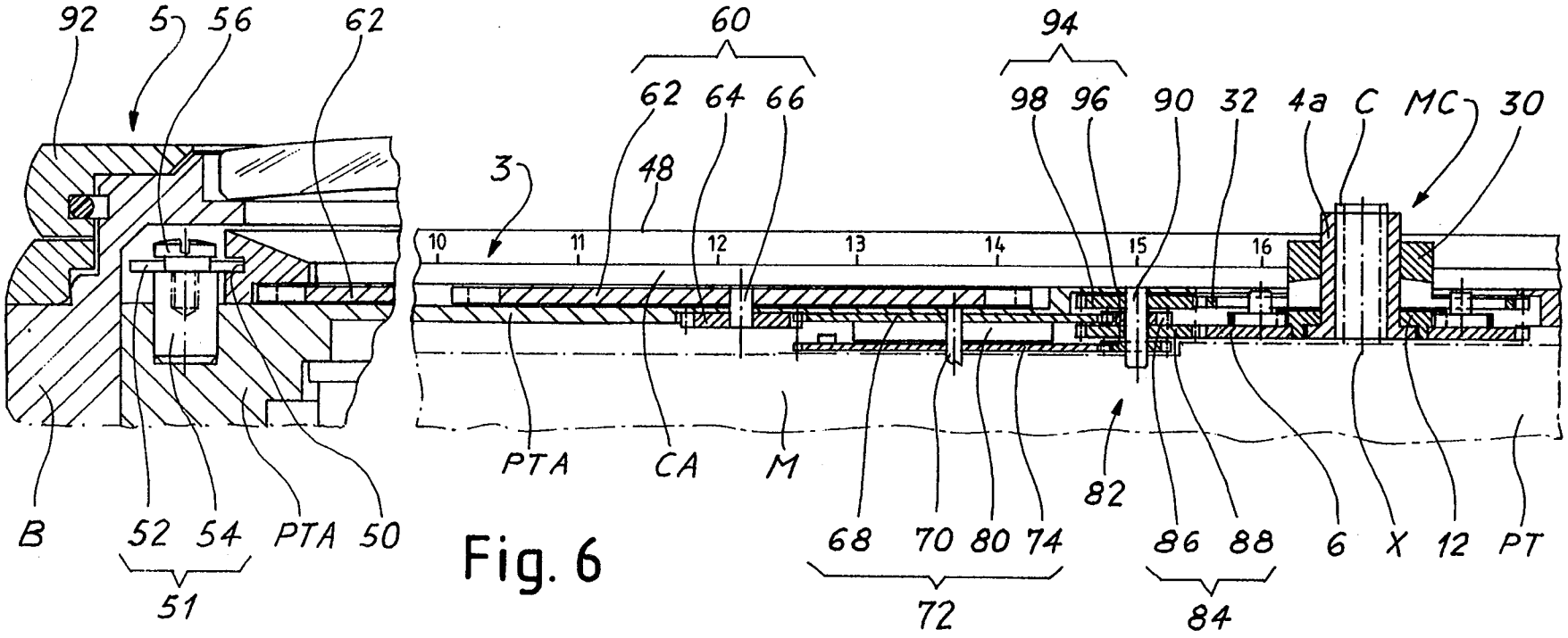
FIGS. 6, 7 and 8 are schematic cross-sectional views of the timepiece according to the invention taken respectively along lines VI—VI, VII—VII and VIII—VIII of FIG. 5 and in which the correction mechanism of FIGS. 1 to 3, although seen according to different cross-section planes, has been shown in an identical manner with the purpose of simplifying the drawings.

The minutes hand 2, hours hand 4 and in the embodiment shown, the first display means 3 are kinematically coupled to a standard horometric movement M (FIGS. 2 and 6 to housed in the case B. The hours hand 4 effects in this example and in a standard manner, one rotation every twelve hours, while the display means 3 effects a rotation every twenty-four hours in the counter-clockwise sense.

As will be understood from the description which follows, the display means 5 including geographical indications is in this embodiment advantageously formed on timepiece P, preferably in a fixed manner, for example on case B or on a crystal, not shown. The display means 3 and 5 provide in combination and in a standard manner the time at different places of the globe over the twenty-four time zones, such time being referred to as universal time.

Figure 3:
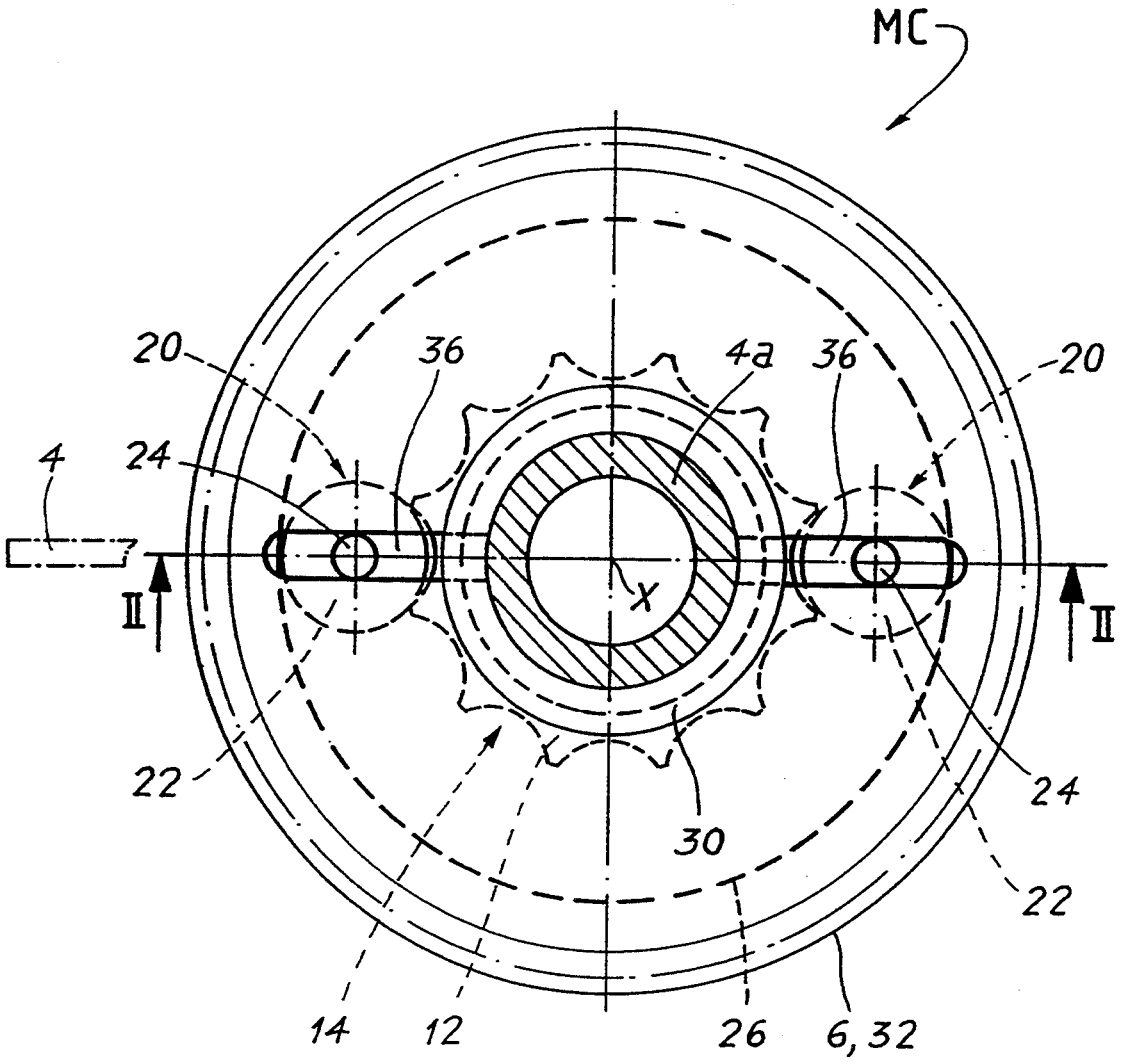
FIG. 3 which is a top view taken along line III—III of FIG. 2 shows the mechanism of FIG. 2 partially in cross-section and in a first position.
Figure 4:
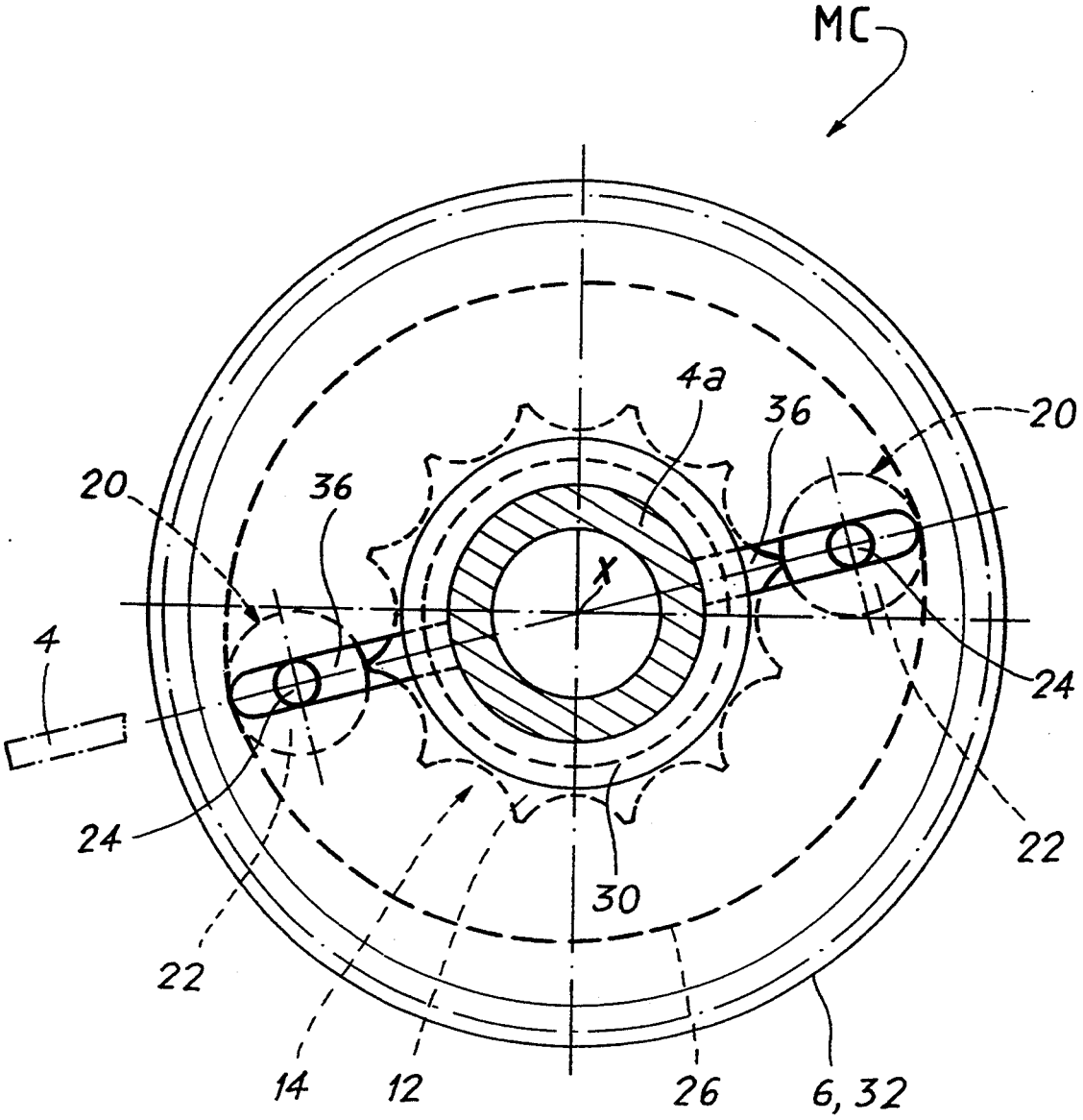
FIG. 4 is a view similar to FIG. 3, but shows the mechanism of the timepiece according to the invention in a second position during passage into another time zone.

Referring henceforward to FIGS. 2 to 4, there will be described hereinafter a correction mechanism MC enabling correction of the position of the hours hand 4, without disturbing the time information furnished by the display means 3 and 5.

As is seen on FIG. 2, the correction mechanism MC includes a first pipe 4*a*, referred to as the inner pipe, intended to be mounted in a standard manner for rotation about a rotation axis X on a cannon pinion C operated by the horometric movement M, both shown in a schematic fashion in interrupted mixed dashes on FIG. 2. The inner pipe 4*a* bears the hours hand 4 which is driven exteriorly on a free end of such pipe projecting beyond dial CA.

The inner pipe 4*a* thus forms an hours pipe and it bears a first exteriorly-toothed wheel 6, referred to as the lower wheel, including a web 7. Here it will be specified that in an advantageous manner such lower wheel 6 forms an hours wheel and it meshes with a dial train pinion 8 (FIGS. 5 and 7) here partially shown, forming part of a dial train of movement M.

In normal operation, such hours wheel 6 receives time information furnished by the dial train pinion 8 which information it transmits, as will be understood hereinafter, indirectly to the inner hours pipe 4*a* and to the corresponding indicating hand 4.

Effectively, the lower hours wheel 6 is mounted to be free in rotation on the hours pipe 4*a*. For this, the hours pipe 4*a* includes at its end opposite the free end bearing hand 4 a collar 10 forming a shoulder freely supporting a star 12 on which is fixedly maintained wheel 6. Star 12 includes a web 13, outer teeth 14 and a circular collar 16 edgewise arranged adjacent, behind and coaxial to teeth 14 under web 13.

The hours wheel 6 is fixedly maintained on the side of star 12 against its teeth 14. Effectively, the hours wheel 6 through the central portion of its web 7 which shows an open bore is forcibly engaged on the exterior of collar 16 by driving and/or by riveting.

Star 12 and hours wheel 6 are thus directly fixed together in rotation and in this example, thanks to their assembly, they form only a single piece mounted on the hours pipe 4*a*.

Star 12 and hours wheel 6 can thus be displaced together in a concomitant manner under the effect of the dial train pinion 8.

The timepiece according to the invention further includes two driving rollers 20 which are stepped and each of which exhibits a cylindrical base 22 from which extends a stud 24 normal thereto. Both rollers are engaged at rest by their base 22 in the teeth 14 of star 12 and they rest freely and laterally by such base against the side, not referenced, of the web 7 of the hours wheel 6. Such rest position is also shown in a top view on FIG. 3.

Rollers 20 are furthermore elastically maintained in this rest position in teeth 14 by elastic return means 26 which here are formed by a closed annular spring coaxially mounted on star 12 and acting radially on the outer periphery of the bases 22 of rollers 2. Here it will be noted that spring 26 is freely mounted against the driving rollers 20 without any fixed attachment to the mechanism MC. Spring 26 furthermore rests freely against and more specifically on web 7 of the hours wheel 6. Such spring is thus self-borne and self-centered.

The correction mechanism MC according to the invention further includes a second pipe 30 referred to as the outer pipe which includes a guide bore 31 and which is exteriorly mounted by such bore 31 onto the first pipe 4*a*. Such second pipe 30 supports a second exteriorly toothed wheel 32 arranged above the lower hours wheel 6 and referred to as the upper wheel. Here it will be specified that the positions upper and lower for wheels 6 and 32 are made with reference to the drawing of FIG. 2 which shows the timepiece according to the invention in its utilization position on the wearer, that is to say, with the hands directed towards the top.

The upper wheel 32 includes a web 33 and it meshes by its exterior teeth with a correcting wheel 34 (FIGS. 5 and 8) which may be operated in a standard manner by a stem T (shown in a schematic manner on FIG. 5), associated with a time setting crown CO (FIG. 1).

The upper wheel 32 thus forms a correction wheel enabling, as will be understood, to directly correct the position of the hours pipe 4*a* and that of the indicating hand 4 without acting on the dial train and thus without disturbing the other time information, such for example as the minute and the second, but also without disturbing the time information furnished by the universal time display means 3 and 5.

In an advantageous manner, the outer pipe 30 is force mounted by driving it exteriorly onto the inner hours pipe 4*a* and it is thus fixed to the latter.

These two pipes are thus fixed in rotation and they may be concomitantly displaced together.

The hours correction via the correction wheel 34 is thus made on the inner hours pipe 4*a* through the outer pipe 30.

It will be specified that the hours pipe 4*a* is further driven in normal operation by the dial train of movement M and in particular by the dial train pinion 8, also thanks to the outer pipe 30.

This is why, in web 33 of the correction wheel 32 radial slots 36 are provided in which are freely engaged studs 24 which may be radially translated in the latter.

Rollers 30 can thus drive in rotation the correction wheel 32 and the two pipes 4*a* and 30, when the star 12 itself is driven by the hours wheel 6.

It will be noted that the radial slots 36 extend from the outer teeth of the correction wheel 32 up to the body of the outer pipe 30 and open out interiorly into the latter, more specifically into its bore 31.

Slots 36 may thus be formed at the same time, with the help of a formed milling cutter, not shown, which is caused to plunge into web 33 of wheel 32 and into pipe 30.

It will also be noted that star 12 is axially maintained between the outer pipe 30 and the collar 10 of the hours pipe 4*a*. Such two pipes which are driven into one another thus form a channel 38 enabling the guidance in rotation and axial maintenance of the mounted assembly constituted by star 12 and the hours wheel 6.

Figure 5:
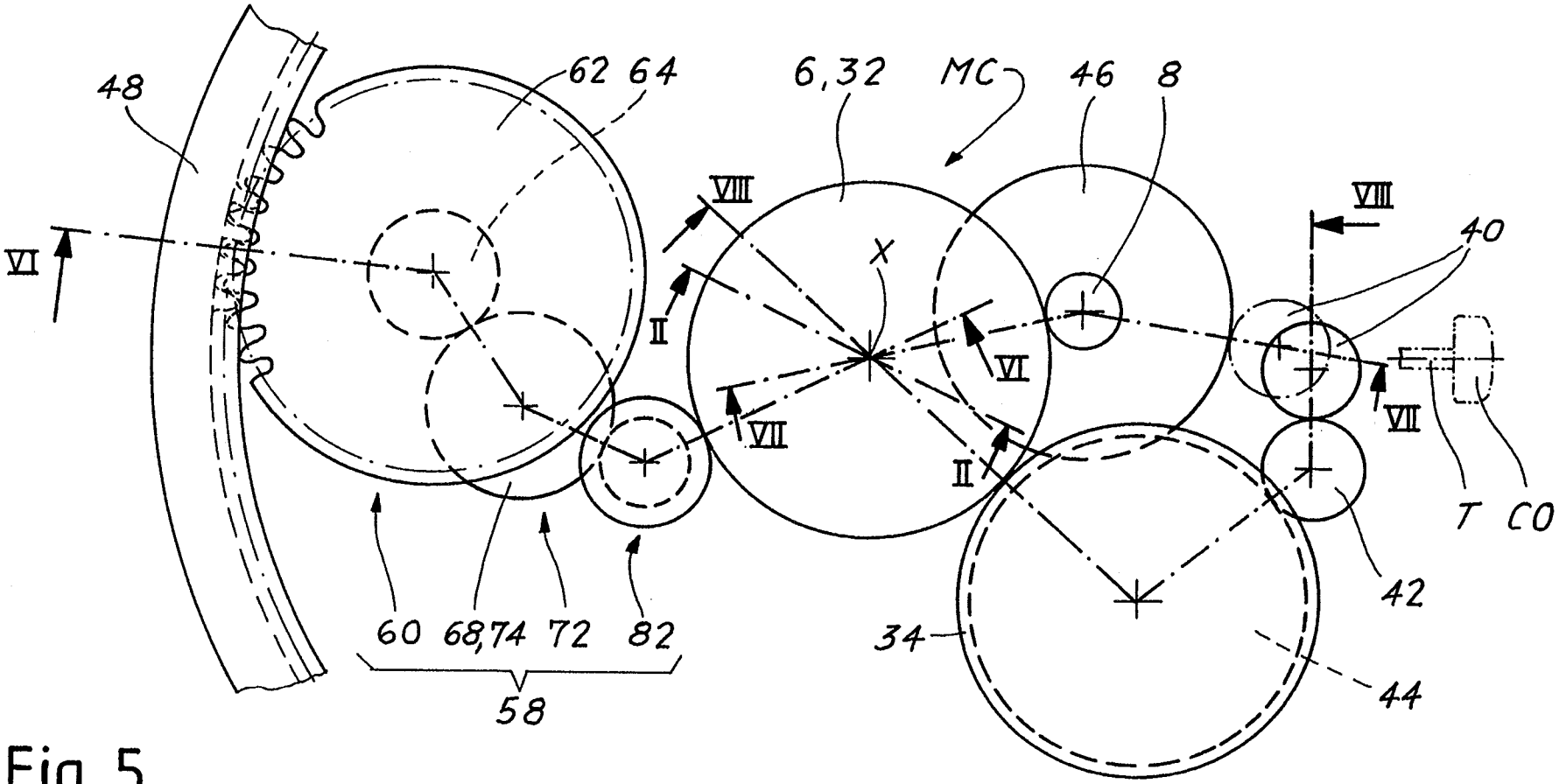
FIG. 5 is a very schematic top view of different driving wheel sets of the timepiece according to the invention.
Figure 8:
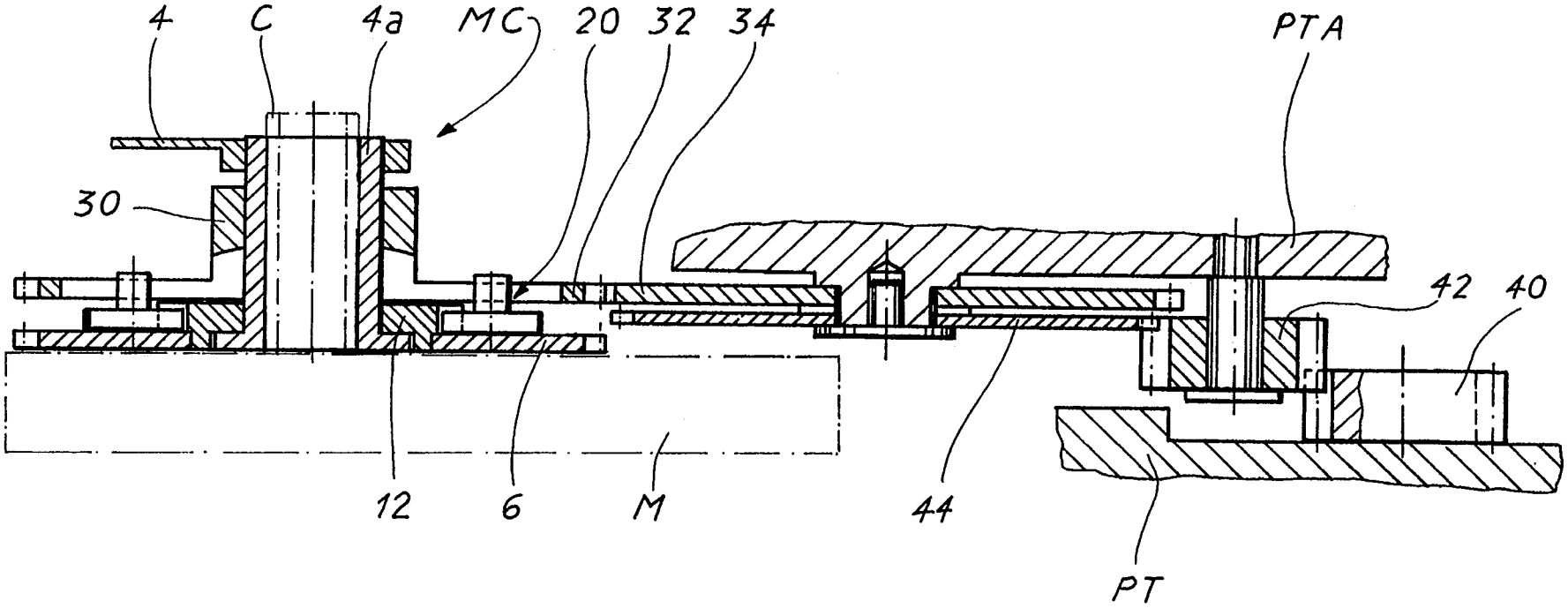

As is seen on FIGS. 5 and 8, the correction mechanism MC may be directly operated by the assembly crown CO/stem T which controls in a standard manner a sliding pinion 40 slidingly assembled in a base plate PT of movement M. When crown CO is turned in a first rotation sense in order to bring about a rapid hours correction, the sliding pinion 40 is brought to mesh with a setting wheel 42 engaged with an intermediate wheel 44 coupled to the correcting wheel 34. Wheels 34 and 44 form a correcting wheel set which, together with the setting wheel 42, are freely supported in rotation on an auxiliary base plate PTA (visible on FIG. 6) mounted on the base plate PT.

Figure 7:
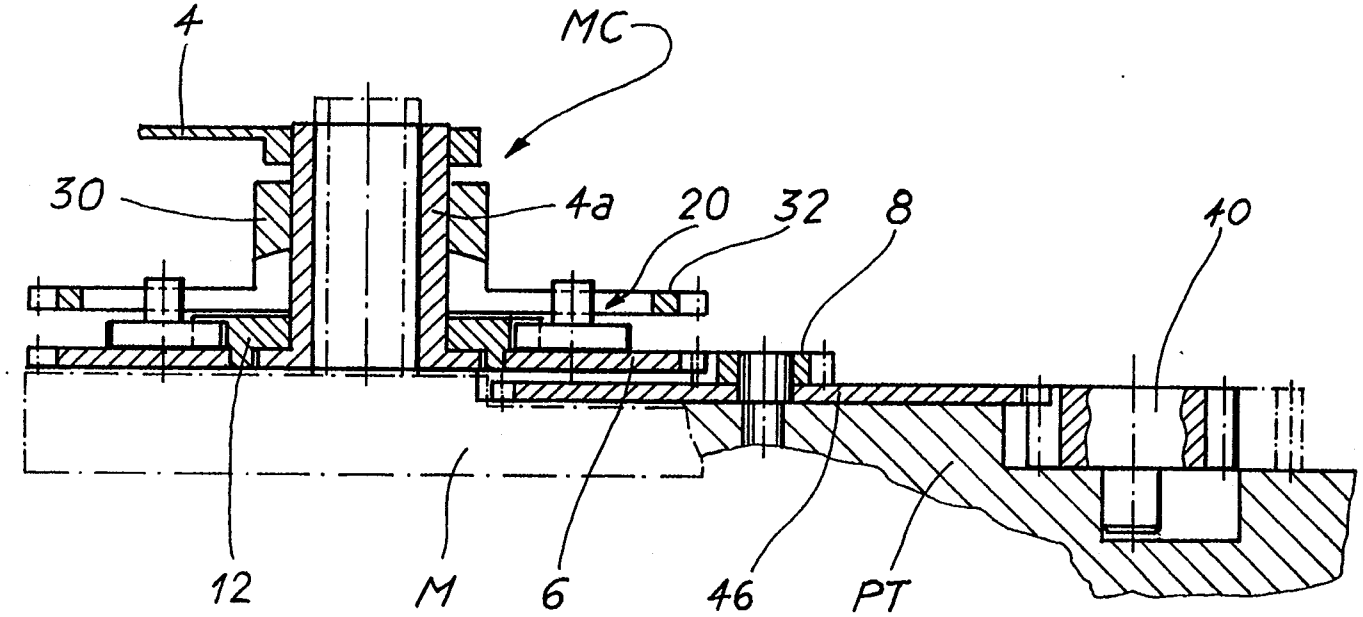

Furthermore, in henceforth referring to FIGS. 5 and 7, it will be noted that when crown CO is rotated in a second rotation sense, the sliding pinion 40 is brought to mesh with a dial train wheel 46 which is coupled to the dial train pinion 8 and which is engaged in a standard manner with the cannon pinion C (not shown). Thus, during standard time setting of the hours and minutes, rotation of the crown CO brings about displacement in rotation of the sliding pinion 40, but also the dial train wheel set 8, 46; which brings about displacement in rotation of the correction mechanism MC in its entirety (wheels 6 and 32).

The timepiece is shown on FIG. 3 (without elements C, M, 8 and 34 ) in a display position corresponding to one of the time zones.

FIG. 4 shows the timepiece according to the invention in an intermediate position during passage into another time zone. It is thus noted that during the placing into rotation of the correcting wheel 34, rollers 20 are angularly displaced and (when star 12 and the hours wheel 6 remain stationary because of their driving by the dial train), such rollers jump over the teeth 14 of star 12 in forcing spring 26 out of round.

Rollers 20 next return into the teeth 14 of star 12 in rest position, but in a manner shifted relative to their initial position (FIG. 3). Hand 4 then indicates another time zone. It will be specified that although the toothing of star 12 includes 12 teeth on the drawings (in order to position hand 4 on the 12 hours), such toothing could include 24 teeth for application to a timepiece of the twentyfour hour display type.

It is understood that the structure which has just been described forms a declutchable coupling mechanism interposed between the hours wheel 6 and the inner hours pipe 4*a* which permits a stepwise correction of the hours display according to the indexed positions corresponding to a whole fraction of the number of hours, without changing the relative position of means 3 and 5 for displaying universal time.

It will also be noted that this structure, of which the hours wheel 6 and the hours pipe 4*a* form part, forms a unit which may be easily removed from the timepiece and which may be easily transportable without risking an untimely separation of its components.

Effectively, rollers 20 are held confined between the correction wheel 32 and the hours wheel 6 which itself is held by the two pipes 4*a* and 30.

Rollers 20 are additionally maintained in place radially by spring 26 which is also confined between the upper wheel 32 and lower wheel 6.

The dismounting of this unitary structure may be readily effected (after it has been removed from the timepiece P), in bearing on the face at the end of collar 16 and disengaging the inner pipe 4*a* by action along arrow D on its end face projecting from the hands side.

In this case, rollers 20 remain supported by web 7 of the hours wheel 6 and the hours pipe 4*a* may be replaced without having separated the other components.

In referring henceforth to FIGS. 5 and 6, there will be described hereinafter the structure of the display means 3 and 5 (FIG. 1) and their coupling with the other components of the timepiece P according to the invention.

In the example shown, display means 3 is formed on a rotary ring 48 (partially shown on FIG. 5) which is assembled and guided in rotation on the auxiliary base plate PTA by guide means 51 including bearings 52. Rotary ring 48 which is arranged in a manner coaxial to dial CA around the latter exhibits at its periphery an outer radial groove 50 in which are engaged bearings 52 (a single one here being shown) constituted in particular by rubies. The guide bearing 52 is freely mounted for rotation on a stud 54 driven into the auxiliary base plate PTA and in which is fixedly engaged a holding screw 56 retaining the bearing 52 which here has the form of a perforated disc.

The timepiece according to the invention preferably includes three bearings of the type mentioned hereinabove capable of assuring guidance and maintenance of the rotary ring 48 axially as well as radially.

Such rotary ring 48 meshes with a driving train 58 (FIG. 5) which controls its rotation.

The driving train 58 is made up by a driving wheel set 60 primarily borne by the auxiliary base plate PTA. Wheel set 60 includes a wheel 62 which is engaged with the rotary ring 48 and which is coupled in rotation with a pinion 64 through an arbor 66 driven into such pinion and into such wheel. Wheel 62 is housed within the auxiliary base plate PTA in a cavity, not referenced, formed in the latter and it is directly arranged under dial CA which covers it over entirely.

It will be noted that such wheel 62 is added onto FIG. 6 in the cross-sectional view of ring 48 for a better understanding of the drawing.

As to pinion 64, this is housed under the auxiliary base plate PTA and it meshes with a wheel 68 freely mounted on an arbor 70 driven into the base plate PT.

Here it will be noted that the wheel 68 forms part of a wheel set 72 referred to as the calendar wheel set comprising furthermore a driving wheel 74 adapted to be able to operate in a standard manner a date disc 76 partially shown on FIG. 1, through an opening 78 formed in dial CA. The calendar driving wheel 74 rotates freely around arbor 70 while resting thereon is a spacer 80 driven onto arbor 70 and supporting wheel 68.

The driving train 58 furthermore includes an intermediate device 82 which includes, as will be understood, two independent groups of wheel sets interleaving one another and freely mounted for rotation relative to one another.

One of the previously cited wheel sets referenced 84 includes a first assembly, wheel 88-pinion 86.

Wheel 88, which is fixedly coupled to pinion 86 and which is arranged directly under the latter, meshes with the hours wheel 6 of the correction mechanism MC while, as to pinion 86, this meshes with the rotary ring 48 in being directly engaged with the wheel 68. Here it will be specified that pinion 86 and wheel 88 form a wheel set loosely mounted on an arbor 90 driven into the base plate PT.

As to the other wheel set referenced 94 of intermediate device 82, this includes a second assembly, wheel 98-pinion 96.

Wheel 98 which is driven onto the common arbor 90 directly above pinion 86 meshes directly with the correction wheel 32 of the correction mechanism MC, while pinion 96, which is also driven onto the common arbor 90, but which is arranged under wheel 88 of wheel set 84, meshes directly with the date driver 74.

Thus, the first wheel set 84 formed by the assembly wheel 88-pinion 86 is loosely mounted on arbor 90 coupling mechanically pinion 96 and wheel 98 of the second wheel set 94.

Here it will be noted that the first wheel set 84 is assembled between pinion 96 and wheel 98 of the second wheel set 94, such two wheel sets 84 and 94 being able to pivot in an independent manner.

It is also noted that the first and the second wheel of the correction mechanism MC, respectively 6 and 32, are coupled respectively to the rotary ring 48 and to the date display formed by disc 76, via the common intermediate device 82. It is noted furthermore that the date display formed by disc 76 is operated by the correction wheel or second wheel 32 of the correction mechanism MC. It is furthermore specified that the first wheel or hours wheel 6 of such correction mechanism MC which is freely mounted for rotation on the hours pipe 4*a*, is adapted to drive the rotary ring 48 at the rate of one revolution in twenty-four hours, in the counter-clockwise sense. More specifically, the correction mechanism MC is interposed between the dial train wheel 34 (FIG. 5) and the driving train 58 which controls rotation of the rotary ring 48. Thanks to this arrangement, it is noted that the correction mechanism MC is adapted to act on the hours hand 4 independently of the driving of rotary ring 48.

Effectively, it is observed that when the correction wheel 32 is operated by the crown CO as has been explained hereinbefore, the angular displacement of the hours hand 4 is effected without bringing about subsequent driving of the hours wheel 6 since such correction wheel 32 does not form part of the driving train 58, being given that it meshes solely and only with the wheel 98 which indirectly operates the date driver 74.

It will also be specified here that thanks to this arrangement, during passage to another time zone and in particular during passage at midnight, the date disc 76 is driven in rotation, which permits passage to the next day. It is noted furthermore that during normal driving of wheels 6 and 32 of the correction mechanism MC rotating at the same speed, the two wheel sets 94 and 84 are also driven at the same speed and are displaced concomitantly on arbor 90 without causing friction on the latter. In this arrangement it will also be specified that wheels 6 and 32 exhibit the same number of teeth which is also the case for the two wheels 88 and 98 and for the two pinions 86 and 96.

FIG. 6 shows furthermore the assembly of the display means 5 on a bezel 92 mounted on case B in a standard manner at the periphery and on the upper portion of the latter.

It will be further specified that, although in the embodiment which has just been described the display means 3, including the twenty-four hour-hours circle, is formed on the rotary ring 48 while the display means 5, including the geographical indications is formed on the outer bezel 92 and in this example is fixed, an inverted arrangement (not shown) may be provided in which the display means 3 is formed on the outer bezel 92 and the display means 5 on the inner rotary ring 48.

What I claim is:

1. A timepiece with a universal time display including:

a watch stem, a horometric movement including a dial train, an hours pipe, an hours hand mounted on said hours pipe and driven by said dial train, a rotary ring driven in order to effect one revolution per twenty-four hours, a first display means including a twenty-four hour-hours circle, a second display means including geographic indications respectively indicating various time zones, one of said display means being arranged on said rotary ring for being displaced with respect to the other of said display means and for furnishing with the latter the universal time display, and—a correction mechanism for acting on said hours hand including a first and a second toothed wheel coaxially mounted on said hours pipe, a jumping device coupling said first and second wheels and means intermediate said first wheel and said ring for permitting said wheel to drive said ring, said first wheel being in gear with said dial train, and being mounted to rotate freely on the hours pipe, said second wheel being secured to said hours pipe for rotation therewith, and means for permitting said second wheel to be operated by said stem for correcting the position of the hours hand without rotating said ring.

2. A timepiece as set forth in claim 1, further including a date display operated by said second wheel.

3. A timepiece as set forth in claim 2, wherein said means intermediate said first wheel and said ring includes a common intermediate device for respectively coupling the first and second wheels to the rotary ring and to the date display.

4. A timepiece as set forth in claim 3, wherein said common intermediate device includes two wheel sets interleaving one another and mounted to be movable in rotation relative to one another.

5. A timepiece as set forth in claim 4, wherein one of the wheel sets includes a first wheel-pinion assembly meshing with the first wheel and with the rotary ring, the other wheel set including an arbor and a second wheel-pinion assembly meshing with the second wheel and with the date display, the first assembly being loosely mounted on said arbor between the pinion and its associated wheel.

6. A timepiece as set forth in claim 1, wherein said jumping device comprises a star gear fixed to said first wheel, rollers, and means for elastically maintaining said rollers in engagement with said star gear, said second wheel having radially oriented slots therein, said rollers being mounted for moving radially in said slots.

7. A timepiece as set forth in claim 6, wherein said jumping device further includes a self-centered spring freely mounted around said rollers for elastically maintaining said rollers in engagement with said star gear.

* * * * *